US007264136B2

(12) United States Patent
Willoughby et al.

(10) Patent No.: US 7,264,136 B2
(45) Date of Patent: Sep. 4, 2007

(54) MEDICATION DISPENSING METHOD AND APPARATUS

(75) Inventors: Christopher Wallace Willoughby, Mountain Brook, AL (US); David Walter Wright, Littleton, CO (US); Lee William Travis, Littleton, CO (US); Jeffrey Clyne Garland, Littleton, CO (US)

(73) Assignee: Concept Medical Technologies, Inc., Birmingham, AL (US)

( * ) Notice: Subject to any disclaimer, the term of this patent is extended or adjusted under 35 U.S.C. 154(b) by 183 days.

(21) Appl. No.: 10/696,698

(22) Filed: Oct. 29, 2003

(65) Prior Publication Data

US 2005/0061825 A1 Mar. 24, 2005

Related U.S. Application Data

(60) Provisional application No. 60/497,843, filed on Aug. 26, 2003.

(51) Int. Cl.
*G07F 11/00* (2006.01)

(52) U.S. Cl. ..... 221/3; 221/13; 221/15; 221/25; 700/236; 700/231

(58) Field of Classification Search ..... 221/3, 221/13, 15, 25, 8, 70, 71, 72; 700/236, 244, 700/230, 231; 83/945, 167; 225/100, 106, 225/4, 5

See application file for complete search history.

(56) References Cited

U.S. PATENT DOCUMENTS 3,985,264 A * 10/1976 Shaw et al. ..... 221/7
5,522,525 A * 6/1996 McLaughlin et al. ..... 221/4
6,181,982 B1 * 1/2001 Yuyama et al. ..... 700/236
6,601,729 B1 * 8/2003 Papp ..... 221/25

* cited by examiner

*Primary Examiner*—Patrick Mackey
*Assistant Examiner*—Thomas Morrison
(74) *Attorney, Agent, or Firm*—John D. Wright; Dickinson Wright PLLC

(57) ABSTRACT

A method and apparatus for dispensing prepackaged medication packages includes an apparatus having a body with an internal cavity and an opening. A central processing unit operably communicates with an actuator and at least one sensor within the cavity to regulate and monitor the dispensation of the packages, while the actuator operably communicates with a feed mechanism within the cavity to dispense the packages.

18 Claims, 6 Drawing Sheets

MEDICATION DISPENSING METHOD AND APPARATUS

REFERENCE TO CO-PENDING APPLICATION

This application claims the benefit of U.S. Provisional Patent Application Ser. No. 60/497,843, filed on Aug. 26, 2003.

BACKGROUND OF THE INVENTION

1. Field of the Invention

This invention relates generally to methods and apparatuses used for dispensing medications, and more particularly to methods and apparatuses that dispense prescribed dosages of medication at prescribed times.

2. Related Art

Medication compliance is the act of taking medications in a prescribed dosage, during a prescribed window of time at prescribed intervals. There exist medications that when not taken at the prescribed time, are best not taken until the next prescribed interval. Clinicians recognize the need to manage the dosage times to assure a safe and efficacious therapy. Clinicians also recognize the important role provided by caregivers and concerned parties in helping the mildly incompetent and forgetful medication using population in helping manage their drug therapy.

Some devices attempt to assist patients with their medication compliance. The devices include medication dispensing machines having loadable disposable cups or loadable reservoirs. In all cases, the patient or caregiver loads the individual cups or reservoirs having the medications therein that are to be dispensed for a prescribed dosage. The patient or caregiver typically programs the medication dispensing interval so that the medication is dispensed at the prescribed time. The patient or caregiver often finds the process of loading and programming the machine to be complicated.

Some dispensing machines retain the medications during the prescribed time until the patient manually requests the dispensing of the medications. This is achieved by requiring the patient to manually interact with the machine to obtain the medications. If the patient fails to request the medications, the medications may be dispensed to a quarantine chamber within the machine. The following medication dispensing interval proceeds as manually commanded by the patient. It is also known to include a caregiver notification system which calls a caregiver to notify them of a missed medication event.

Some methods attempt to assist patients with their medication compliance by providing prepackaged medications. Prepackaged medications are available from licensed pharmacies in individually labeled packages. These packages may be labeled with critical information in the form of text regarding the patient, contents, date and time of dosage. Packages may be attached in a sequential fashion allowing the patient to manually remove a single package containing prescribed doses of medication at a specified time. Utilizing a central point of packaging allows for drug interaction screening and multiple drug dosage control by a licensed pharmacist.

SUMMARY OF THE INVENTION

An apparatus for dispensing prepackaged medication to a patient or caregiver includes a monitoring system for actively managing the patient's compliance in taking their medication. The apparatus has a body with an opening and an internal cavity. An actuator and a feed mechanism are received in the cavity and operably communicate with one another to dispense the packages through the opening. A central processing unit operably communicates with the actuator and at least one sensor to automatically regulate the dispensation of packages at the prescribed times and to monitor the patient's compliance with taking their medication as prescribed.

Another aspect of the invention includes a method of dispensing packages of medication to a patient or caregiver. The method includes providing packages containing predetermined doses of medication and a medication dispensing machine. Next, loading the packages into the machine and making a package accessible over a predetermined interval of time. Thereafter, making the package inaccessible if the package is not removed from the machine.

Objects, features and advantages of this invention include a method and apparatus for dispensing medication that automatically notifies a source when it is time to take medication, allows a source to communicate with the apparatus to check on a patients compliance in taking their medication, allows a user to manually program in the prescribed times in which to take medication, has a reading device to automatically determine when the medication needs to be dispensed from the apparatus, has an interface screen allowing a user to actively program the apparatus, has an ability to automatically send a signal to a communication device to notify a user that it is time to take medication or that a problem exists, automatically captures medication not taken within a prescribed amount of time, is of relatively simple design, is economical in manufacture and assembly, and improves the ability of a patient to maintain compliance in taking their medication.

BRIEF DESCRIPTION OF THE DRAWINGS

These and other objects, features and advantages will become apparent in view of the following detailed description of the presently preferred embodiments and best mode, and accompanying drawings, in which.

DETAILED DESCRIPTION OF THE PREFERRED EMBODIMENTS

Figure 1:
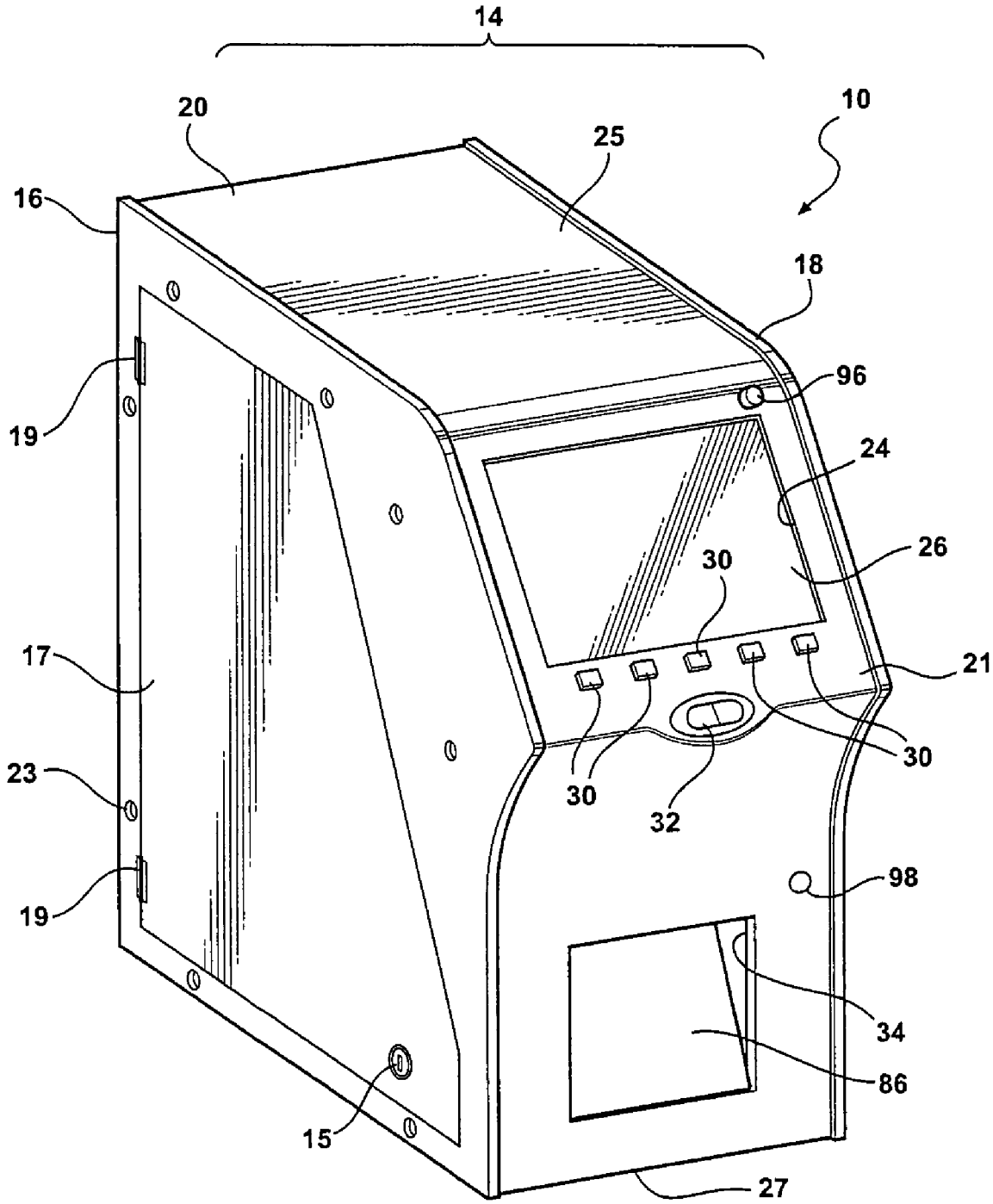
FIG. 1 is a perspective view of a medication dispensing apparatus constructed according to one presently preferred embodiment of the invention.
Figure 2:
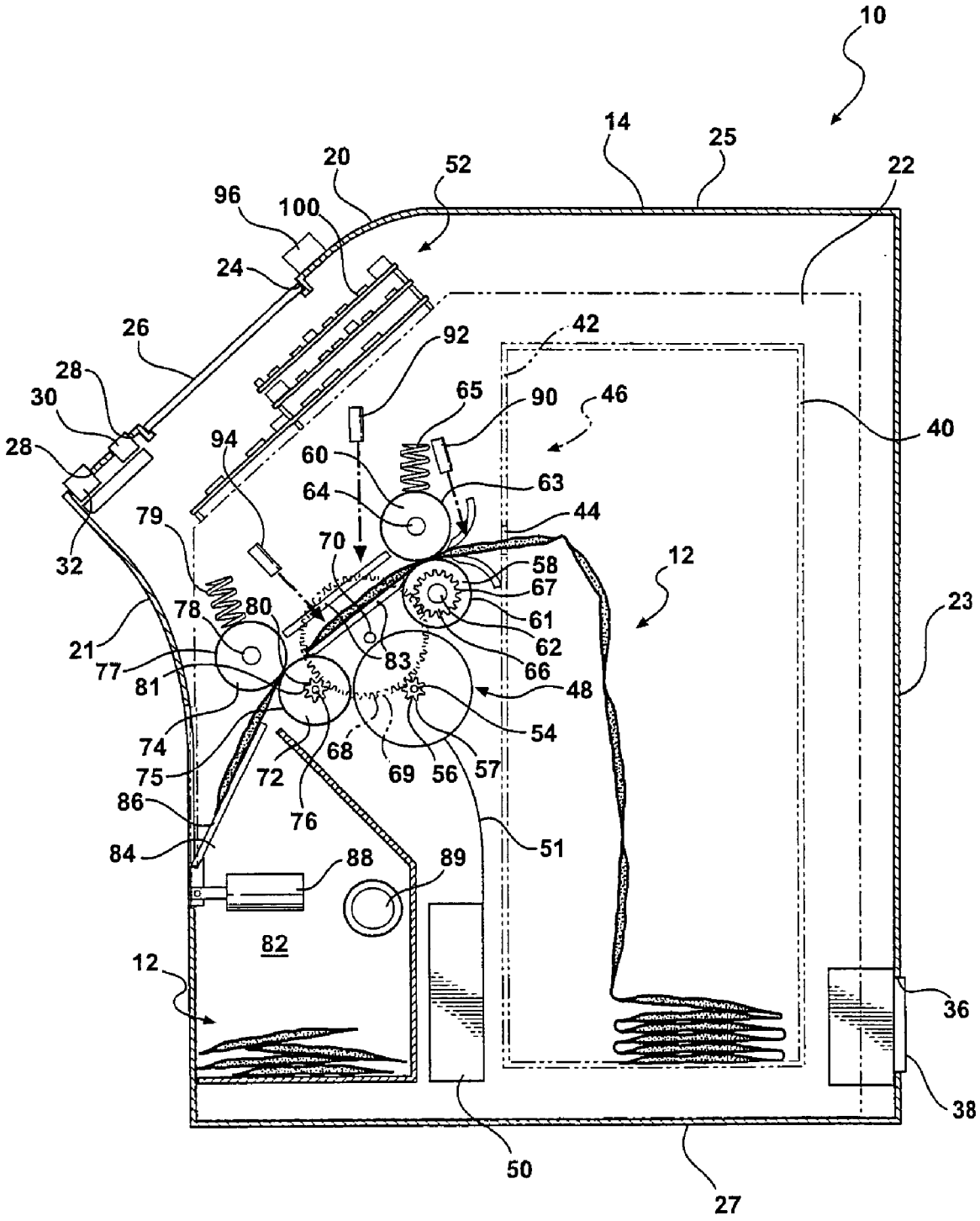
FIG. 2 is a side view of the apparatus with a side plate removed showing an interior cavity and a plurality of internal components therein.

FIGS. 1 and 2 illustrate a medication dispensing machine or apparatus 10 that provides a patient or caregiver to the patient an ability to dispense medications in prescribed dosages and during prescribed intervals of time. The medications are contained in prepackaged and labeled packages 12 to provide the patient with the proper dosage of medications at a prescribed time. The apparatus 10 allows the dispensation of medication to be monitored and controlled so that the patient, caregiver, or any other person having access, either directly or remotely, to the apparatus 10 can be assured that the patient is taking the medication as prescribed. Additionally, the apparatus 10 can notify the patient, or others, when it is time for the patient to take medication, and if the medication has not been taken within a predefined window of time.

The apparatus 10 has a body 14 preferably having a pair of side walls 16, 18 attached to a housing 20 having front and rear panels 21, 23 and top and bottom surfaces 25, 27 to define an internal cavity 22 (FIG. 2). One of the side walls, shown here as the side wall 16 has a door or access panel 17 arranged for pivotal movement about a set of hinges 19 so that an authorized person can gain access to the inside of the apparatus 10. Preferably, the access panel has a lock 15 to prevent unauthorized persons from gaining access to the inside of the apparatus 10. It should be recognized that the body 14 may be constructed from any suitable material, for example plastic or metallic materials, and further, that any suitable method of construction may be used to fabricate the body 14, for example injection molding, stamping, machining, and the like.

The housing 20 may be constructed as a single piece of material, or otherwise constructed from two or more pieces of material attached to one another. The front panel 21 has an opening 24 for receiving an interface screen 26 and a plurality of smaller openings 28 (FIGS. 6-8) for receiving "soft" or interfacing keys 30 and a dispensing actuator, represented in one form as a button 32 having a pictorial representation of a pill thereon (FIG. 1). The dispensing actuator 32 may be a finger or thumb print recognition pad 32 to restrict dispensation of the packages 12 to a person having proper authorization. The finger or thumb print information of the authorized people may be programmed into the apparatus 10, as necessary. In addition, the dispensing actuator 32 may be a voice recognition microphone, eye or retina scanning mechanism, or other recognition system that would restrict dispensation of the packages 12 to authorized individuals having the requisite identification features to trigger dispensation of the packages 12 from the apparatus 10. Each interface key 30 is able to effectively change definition and control a variety of functions, depending on the mode selected by the user, as discussed in more detail hereafter. The front panel 21 also has an opening 34 through which the individual packages 12 are dispensed at their individually specified or prescribed times. Desirably, the rear panel 23 has an opening 36 through which a power module 38 may be accessed.

Figure 4:
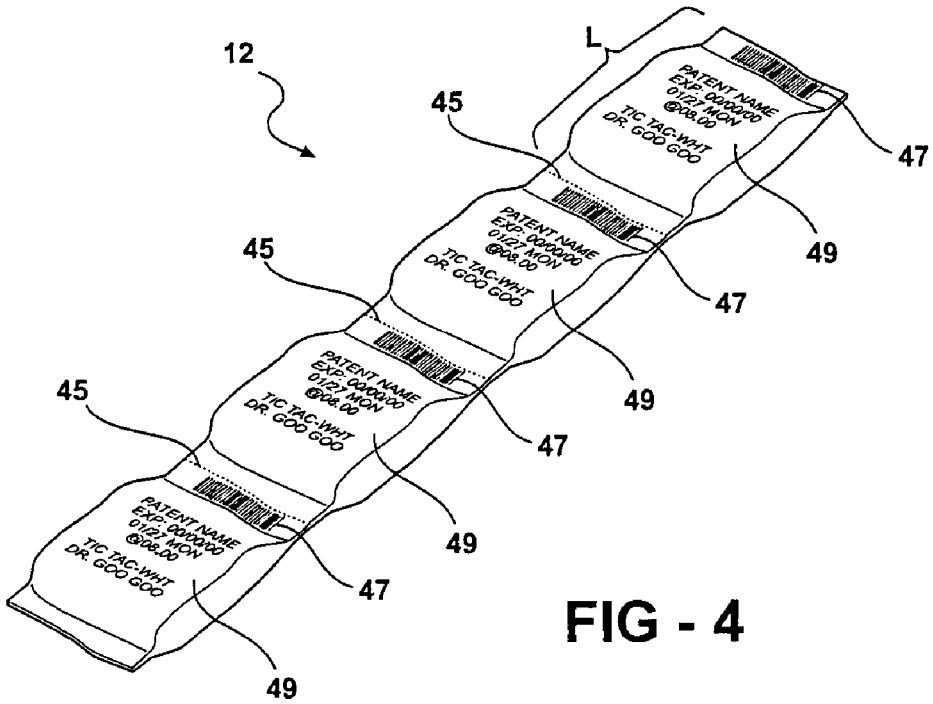
FIG. 4 is a partial perspective view of one form of prepackaged doses of medication.

As shown in FIG. 2, the apparatus 10 accommodates a container 40 sized for receipt in the cavity 22 of the body 14. The container is preferably generally rectangular in shape and is sized to accommodate a plurality of packages 12. In one embodiment, as shown in FIG. 4, the packages 12 adjacent one another are joined along a perforated seam 45, and are preferably stacked one on top of another, in a folded accordion fashion, within the container 40. It should be recognized that the packages 12 may also be coiled about a spool, or otherwise stored within the container 40. Desirably, the container 40 has a wall 42 with a slot 44 through which the packages 12 of medication pass during advancement of the packages 12. The container 40 preferably can hold a significant supply of medication, for example, a one month supply of medication or more. Preferably, the container is loaded with the packages 12 by a licensed individual, for example a pharmacist. It should be recognized that the container 40 serves to maintain the packages 12 in position so that they can readily unfold or uncoil, for dispensation from the apparatus 10.

As shown in FIG. 4, the packages 12 are preferably individually sealed pouches joined to one another at the perforated seam 45. This provides a string of interconnected packages of medication. As mentioned above, the packages 12 are preferably prepackaged by a licensed pharmacist and labeled, encoded, or otherwise identified to indicate their individual contents. Desirably, a bar code 47 is used to encode all the information, for example, dosage time to be taken, name of patient, types of medication, amount of medication and the like. It should be recognized that in addition to or in place of the bar code 47, preferably the above information is labeled in optically readable text 49, or some other form of readable information, for example symbols or braille. By having the medication prepackaged, the pharmacist can perform a drug interaction screen to ensure the medications in the package do not have adverse reactions with one another. In addition to the packages 12 being labeled with the patient information described above, specified packages 12 may include information in the form of instructions to facilitate the operation of the apparatus 10. The instructions may take the form of downloadable software to in affect program or initialize a programmable device, represented here by a central processing unit (CPU) 52 within the apparatus 10, for example. The instruction may include set-up information, preferably on a leading package 12, to communicate with the CPU 52 to provide the apparatus 10 with specific operating instructions. It should be recognized that any desired package 12 within the string of packages 12 could include information to facilitate operation of the apparatus 10, thereby changing the mode of operation of the apparatus at predetermined times.

Referring again to FIG. 2, to advance and dispense the packages 12 of medication, the apparatus 10 has a feed mechanism represented generally at 46. The feed mechanism 46 has, in part, an actuator, represented here by example as an electric motor 48. The motor 48 is operably connected to a controller 50, such as by a wire connection 51, for example, wherein the controller 50 is in operable communication with the CPU 52, for example, by a wire connection (not shown). The motor 48 has a shaft 54 with a drive member, represented by example as a drive gear 56 having a predetermined number of radially outwardly extending teeth 57. The drive gear 56 is attached to the shaft 54 for conjoint rotation with the shaft 54.

The feed mechanism 46 also has a first pair of rollers, referred to hereafter as a pair of feed rollers 58, 60 having relatively compliant outer surfaces 61, 63 supported for rotation with a pair of generally parallel shafts 62, 64, respectively. The feed rollers 58, 60 are laterally spaced from one another a distance great enough to allow the packages 12 to pass therethrough, but also a distance providing for engagement of the rollers 58, 60 with the packages 12. The compliant outer surfaces 61, 63, for example rubber, silicone, foam, or the like, facilitate feeding the packages 12 between the rollers by creating frictional engagement with the packages 12. At least one of the shafts 62, 64 fixed to the feed rollers 58, 60 may be biased by a spring 65, shown here as shaft 64, to bias the shafts 62, 64 toward or away from one another, thereby allowing the feed rollers 58, 60 to move laterally toward and away from one another while accommodating and engaging the packages 12 as they pass between the feed rollers 58, 60. It should be recognized that the feed rollers 58, 60 may initially engage one another, while moving laterally away from one another as the packages 12 pass between the feed rollers 58, 60.

One of the feed rollers 58 has a driven member, represented here by example as a driven gear 66 attached to the shaft 62 with a predetermined number of teeth 67 extending radially outwardly from the driven gear 66 so that the feed roller 58 rotates about its longitudinal axis in response to rotational movement of the driven gear 66, the drive gear 56 and the motor 48. The other feed roller 60 is desirably arranged to freewheel and rotate in response to the rotational movement of the feed roller 58.

Desirably, the motor 48 is in operable communication with the feed roller 58 through the incorporation of an idler member, represented here by example as an idler gear 68 having a predetermined number of outwardly extending teeth 69 supported for rotation about a shaft 70. The teeth 69 of the idler gear 68 are arranged to mesh with both the teeth 57 of the drive gear 56 and the teeth 67 of the driven gear 66. Accordingly, as the drive gear 56 of the motor 48 rotates, the idler gear 68 rotates, thereby causing the driven gear 66 and the feed roller 58 to rotate.

The feed mechanism 46 also has a pair of dispensing rollers 72, 74 laterally spaced from the feed rollers 58, 60, shown here a having a space greater than a length (L) of a single package 12 (FIG. 4). The dispensing rollers 72, 74 have relatively compliant outer surfaces 75, 77 supported for rotation with a pair of generally parallel shafts 76, 78, respectively. The dispensing rollers 72, 74 are laterally spaced from one another a distance great enough to allow the packages 12 to pass therethrough, but also a distance providing for engagement of the dispensing rollers 72, 74 with the packages 12. The compliant outer surfaces 75, 77 are similar as that to the feed rollers 58, 60, thereby facilitating dispensation of the packages 12 between the dispensing rollers 72, 74. At least one of the shafts 76, 78 fixed to the dispensing rollers 72, 74, shown here as shaft 78, may be biased by a spring 79 to bias the shafts 76, 78 toward or away from one another, thereby allowing the dispensing rollers 72, 74 to move laterally toward and away from one another while accommodating and engaging the packages 12 as they pass between the dispensing rollers 72, 74. It should be recognized that the dispensing rollers 72, 74 may initially engage one another, while moving laterally away from one another as the packages 12 pass between the dispensing rollers 72, 74. It should also be recognized that the feed roller shafts 62, 64 are arranged in a generally parallel orientation relative to the dispensing roller shafts 76, 78.

One of the dispensing rollers 72 has a driven member, represented here by example as a driven gear 80 attached to the shaft 76 with a predetermined number of teeth 81 extending radially outwardly therefrom to mesh with the teeth 69 extending from the idler gear 68. Accordingly, the dispensing roller 72 rotates about its longitudinal axis in response to rotational movement of the motor 48, the idler gear 68 and the driven gear 80. The other dispensing roller 74 is desirably arranged to freewheel and rotate in response to the rotational movement of the dispensing roller 72. Desirably, the driven gear 80 has fewer teeth than the driven gear 66 of the feed roller 58.

With the driven gear 80 having fewer teeth than the driven gear 66, the dispensing rollers 72, 74 are caused to rotate at a slightly greater rotational velocity than the feed rollers 58, 60. Accordingly, as the packages 12 pass between the feed rollers 58, 60 and the dispensing rollers 72, 74, and preferably between a pair of generally transparent support plates 83, the packages 12 are placed in tension between the feed rollers 58, 60 and the dispensing rollers 72, 74. As a result, the packages 12 tear from one another along the preformed perforation 45 between the adjacent packages 12, thereby causing a single package 12 to separate from the remaining string of packages 12 in the cavity 22 of the apparatus 12. The single package 12 is then dispensed through the opening 34 in the housing 20, as discussed in more detail hereafter.

Figure 3:
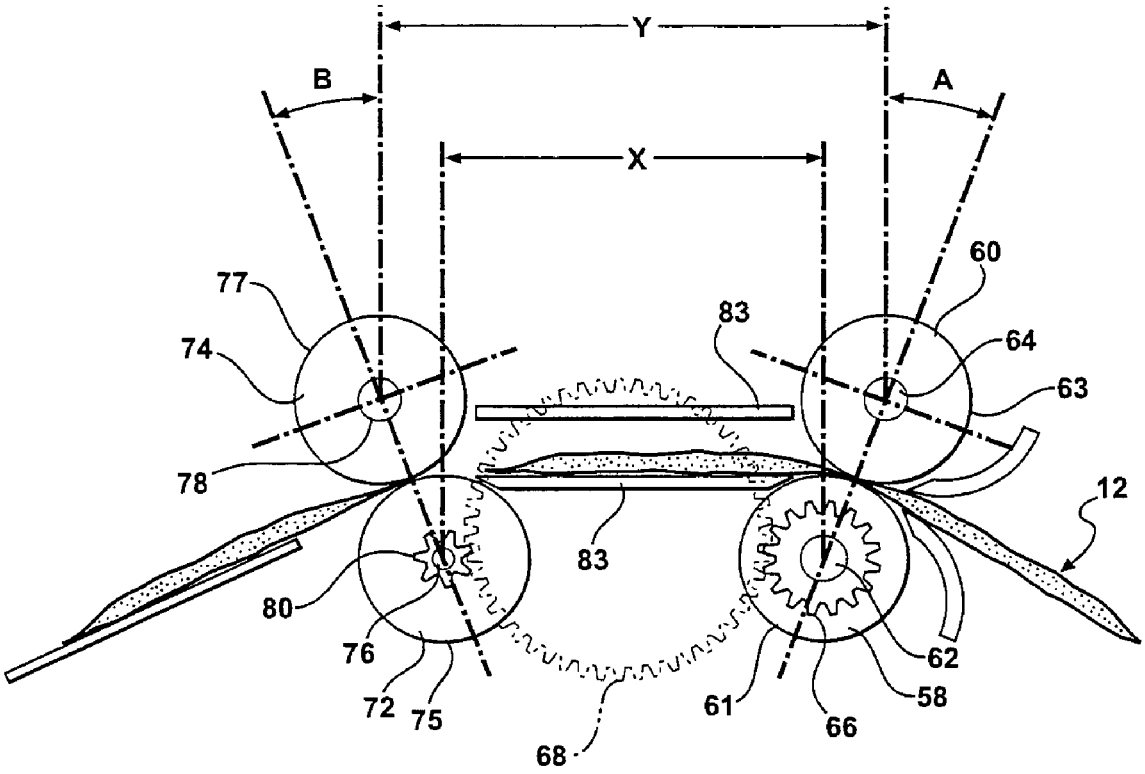
FIG. 3 is a partial side view of a feed mechanism of the apparatus of FIG. 1.

As shown in FIG. 3, to facilitate dispensation of the packages 12 between the feed rollers 58, 60 and the dispensing rollers 72, 74, the shaft 62 of the feed roller 58 and the shaft 76 of the dispensing roller 72 are spaced apart a first distance (X), while the shaft 64 of the feed roller 60 and the shaft 78 of the dispensing roller 74 are spaced apart a second distance (Y), such that the distance (Y) is preferably greater than the distance (X). Accordingly, angles (A) and (B) are defined, with each of the angles (A) and (B) being generally between 0-90 degrees, desirably between 15-45 degrees, and preferably between 25-35 degrees. Having the feed rollers 58, 60 in an angled orientation relative to the dispensing rollers 72, 74 causes the packages 12 to engage one of the feed rollers 58 and one of the dispensing rollers 72 about a portion of their outer surfaces 61, 75, respectively. As a result, an increased frictional engagement of the feed roller 58 and the dispensing roller 72 with the packages 12 occurs as the packages 12 pass between the feed rollers 58, 60 and the dispensing rollers 72, 74.

As shown in FIG. 2, the apparatus 10 has a chamber 82 for capturing packages 12 of medication not taken within a predefined specified time interval. The chamber 82 is located generally beneath the feed mechanism 46 and has an opening 84 positioned directly beneath the dispensing rollers 72, 74. A lid 86 acting both as a top to the chamber 82 and, at least in part, as a dispensing chute for the packages 12 is arranged for pivotal movement between a closed and open position. When the lid 86 is in the closed position, the lid 86 covers the opening 84 so that the packages 12 dispensed from the dispensing rollers 72, 74 land on top of the lid 86 and slide through the opening 34. However, when the lid 86 is in the open position, the lid 86 obstructs the opening 34 and uncovers the opening 84 to the chamber 82 so that packages 12 dispensed between the dispensing rollers 72, 74 fall into the chamber 82. Upon the package 12 falling into the chamber 82, the lid 86 returns to its closed position, and the package remains in the chamber 82 until a person having authorization can access the chamber 82. To facilitate movement of the lid 86, an actuator, such as a solenoid 88 for example, moves between a retracted position and an extended position to open and close the lid, respectively.

To initiate movement of the actuator 88 between its extended and retracted positions, the actuator 88 is operably connected to the CPU 52. The CPU 52 is programmed to send a signal to the solenoid 88 to actuate the solenoid 88 to its retracted position when the patient or caregiver fails to press the dispensing button 32 within a predefined time interval from the specified time at which the medication is to be taken. Accordingly, as a result of the failure of the patient or caregiver to press the dispensing button 32, the lid 86 is moved to its open position via the signal sent to the solenoid 88 by the CPU 52, while the CPU 52 concurrently sends a signal to the controller 50 to actuate the motor 48.

Accordingly, the feed mechanism 46 feeds the package 12 that was not taken within the predefined time interval so that the package 12 is automatically fed by the apparatus 10, and ultimately the package 12 not taken passes through opening 84 and into the chamber 82. Thereafter, the CPU 52 deactivates the motor 48 and the solenoid 88, thereby returning the lid 86 to its closed position. Any packages 12 dispensed into the chamber 82 are maintained or locked within the chamber 82 until a person having access to the chamber 82, such as through the use of a proper key to unlock a lock cylinder 89, accesses the chamber 82 to retrieve the packages 12 of medication not taken by the patient.

To facilitate loading the packages 12 into the feed mechanism 46, a detection device or first sensor 90 arranged for communication with the CPU 52 is arranged generally between the container 40 and the feed rollers 58, 60. Accordingly, as the user feeds the first package 12 in a string of packages 12 into engagement with the feed rollers 58, 60, the sensor 90 sends a signal to the CPU 52, wherein the CPU 52 energizes the motor 48. The motor 48 then causes the feed rollers 58, 60 to rotate to advance the packages between the feed rollers 58, 60 and toward the dispensing rollers 72, 74. The sensor 90 could be supplemented or replaced with a button so that the user can manually load the packages 12 into the feed mechanism 46 by depressing the button to actuate the motor 48. As the first package 12 advances toward the dispensing rollers 72, 74, a reading device or second sensor 92, for example an optical character recognition (OCR) device, an optical bar code scanner, or the like, is in operable communication with the CPU 52 and reads or detects information on the package 12, for example, the text 49, the bar code 47 or any other information, for example symbols, to relay the information to the CPU 52. As the package 12 continues toward the dispensing rollers 72, 74, the package 12 encounters a pre-tear sensor or third sensor 94 also in operable communication with the CPU 52. The pre-tear sensor 94 sends a signal to the CPU 52, wherein the CPU 52 sends a signal to the motor 48 to de-energize the motor 48, thereby stopping the advancement of the packages 12 prior to the dispensing rollers 72, 74. The packages 12 remain in this position until the prescribed dosage time, previously communicated to the CPU 52, arrives. Upon the arrival of the prescribed dosage time, the CPU 52 energizes the motor 48 to start the feed process of the packages 12 to either dispense the package 12 to a user, or to dispense the package 12 into the chamber 82 for containment until an authorized person accesses the chamber 82 to remove the unused package 12 of medication.

Figure 5:
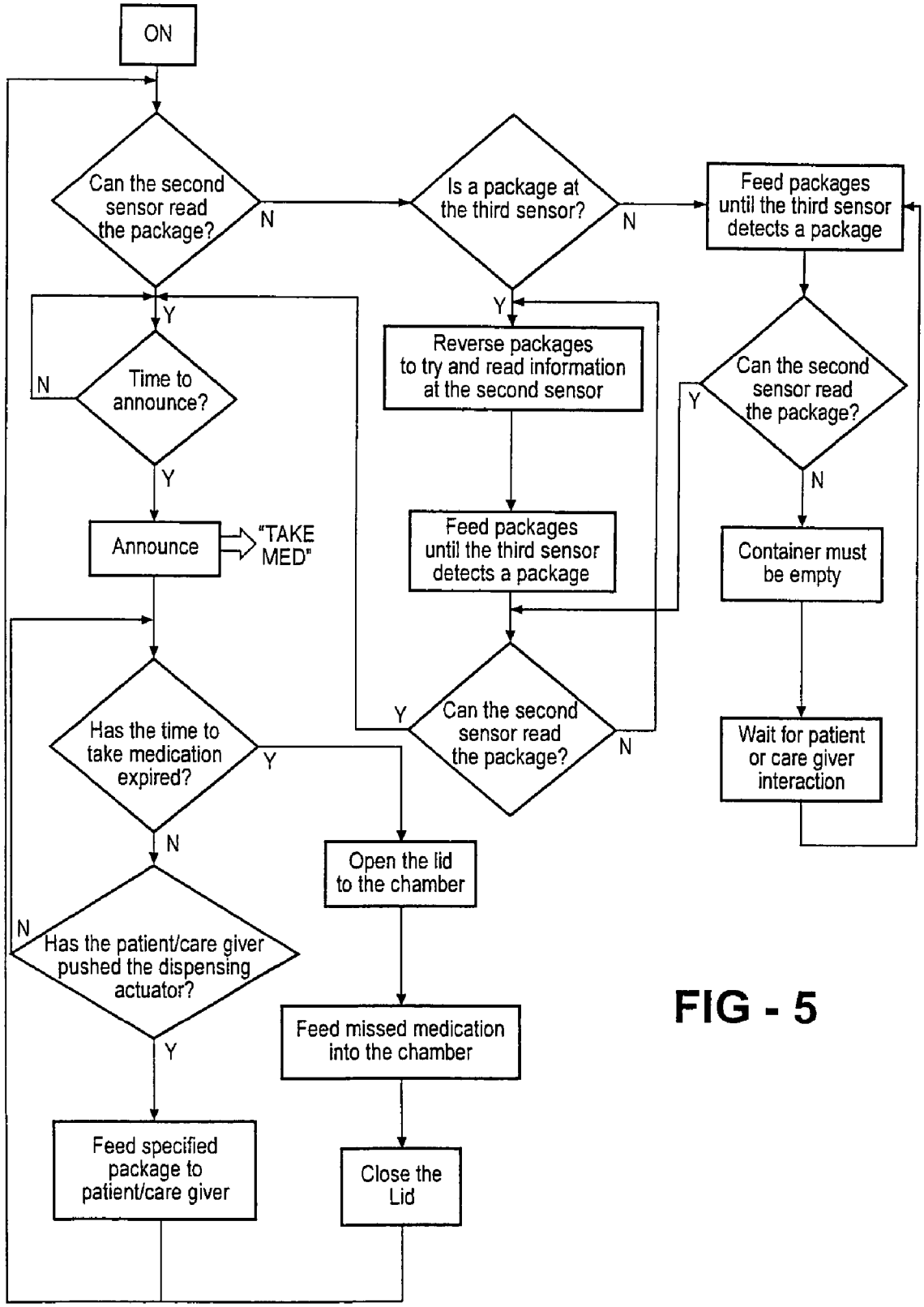
FIG. 5 is a flow diagram showing a presently preferred logic process of the medication dispensing apparatus.

As shown schematically in FIG. 5, when the apparatus 10 is turned on, the reading device 92 communicates with the CPU 52 to make certain the bar code 47, text 49 or other readable information is in a readable position. If the bar code 47, text 49 or otherwise readable information is not in a readable position, the CPU 52 communicates with the motor 48 via the controller 50 to energize the motor 48. The motor then cycles forward and backward until the bar code 47 and/or text 49 is in a readable position. The motor 48 continues to cycle forward and backward for a predetermined, programmed amount of time. If after the time lapses, the bar code 47 and/or text 49 is still not readable, the apparatus 10 will notify the patient and/or caregiver that the packages 12 are either empty, or that a problem exists, as discussed in more detail hereafter. The apparatus may dispense any unreadable packages 12 into the chamber 82, and attempt to read the next available package 12.

Figure 6:
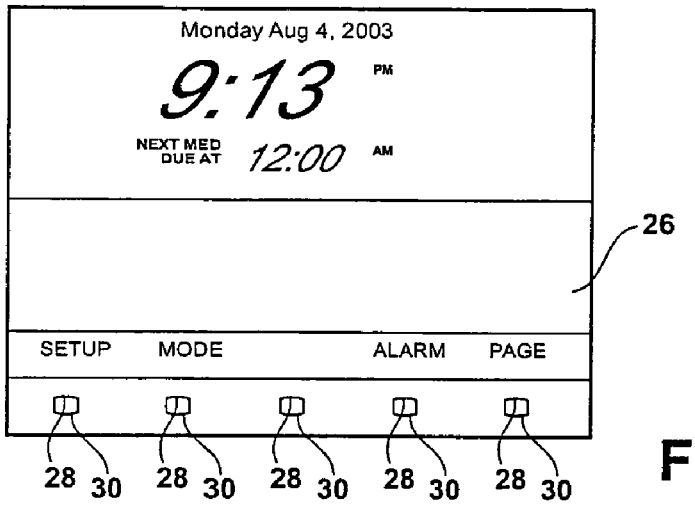
FIG. 6 is a view showing an interface screen of the medication dispensing apparatus in a regular operating mode.

Upon reading the information from the text 49 and/or bar code 47, the CPU 52 communicates with the interface screen 26, as shown in FIG. 6, to visually display the current time, while also displaying the time at which the next dosage of medication is to be taken. At the time the patient is to take their medication, the display panel 26 notifies the user by way of a notification mechanism, for example and without limitation, a flashing signal, such as a flashing bulb 96 (FIGS. 1 and 2) and/or the time on the display panel 26. Additionally, an audible alarm 98 may be programmed to sound by entering a time by depressing the "alarm" key 30 (FIG. 6) so that the user can be alerted while not having visual contact with the display panel 26, let alone the apparatus 10. The audible alarm 98 may take on any variety of forms, for example a buzzer, pre-recorded voice announcement, or the like.

Upon being notified, the user presses the dispensing button 32 to energize the feed mechanism 46. It should be understood that prior to the arrival of the designated interval or window of time for taking a prescribed dosage of medication, the button 32 is de-energized, and therefore, does not actuate the motor 48 to initiate the dispensation of medication from the apparatus when pushed. When the designated window of time to take the medication arrives, the CPU 52 relays a signal to energize the button 32, wherein the button 32 remains energized throughout the designated interval of time. Accordingly, upon pressing the button 32 during the designated window of time for taking a prescribed dosage of medication, the motor 48 is actuated. Accordingly, the prescribed package 12 containing the proper dosage of medications for the specified time interval is fed between the dispensing rollers 72, 74 until the package 12 tears from the remaining packages 12 at the perforated seam 45 located between the feed rollers 58, 60 and the dispensing rollers 72, 74. The package 12 that is separated from the remaining strip of packages 12 is then dispensed through the opening 34 to the user. Otherwise, if the user does not press the dispensing button 32 within the predefined window of time, as discussed above, the CPU 52 relays a signal to de-energize the button 32. Thereafter, the package 12 not dispensed to the user during its designated window of time is dispensed automatically by the feed mechanism 46 into the chamber 82.

Figure 7:
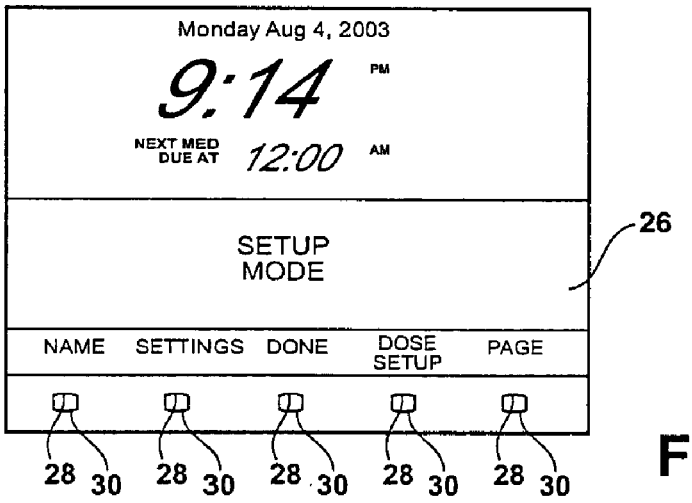
FIG. 7 is a view of the interface screen in a set-up mode.

As shown in FIGS. 6 and 7, the user may program the apparatus 10 by pressing the appropriate keys 30, for example "name", "page" or "alarm" and inputting the desired information. Accordingly, the information may be processed by the CPU 52 where the information is used, at least in part, to notify the patient or caregiver when the specified time arrives to take medication. The notification may take the form of a signal being sent to a pager, phone, email system, or other electronic device, for example a computer or wireless device. The contact information programmed via the keys 30, or otherwise communicated through information on a package 12, into the CPU 52 is communicated to a modem and/or a wireless communication board 100 through an operable connection between the communication board 100 and the CPU 52. Accordingly, when the specified interval of time comes to take medication, the CPU 52 sends a signal to the communication board 100, which in turn sends a signal to the specified communication receiver, be it a pager, phone, email system, or other electronic device, as mentioned above. As a result, the patient or designated caregiver can be further notified that it is time for the patient to take their medication. Aside from the communication board 100 notifying the patient and/or caregiver that it is time to take medication, the communication board can also notify the patient and/or caregiver when the reading device 92 fails to read a package 12.

Additionally, the communication board can be programmed to automatically notify the caregiver if the patient fails to take their medication. It should be recognized that the communication board 100 and the CPU 52 could be constructed as a single unit or module, thereby reducing the amount of space required for the single unit, and also improving the efficiency of manufacture and assembly.

Other than the communication board 100 sending a signal to the electronic devices listed above, the patient or caregiver can access the CPU 52 by way of the communication board 100 by dialing-in to the communication board 100. It should be understood that any suitable communication device may be used to dial-in to the communication board, for example phones (cell, cordless, hardwired or otherwise), or computer devices (desktop, PDA, Handheld PC, laptop or otherwise). Accordingly, the patient, caregiver, or other designated party may access saved information in the CPU 52 to obtain information regarding the patient's compliance in taking their medication. As such, the caregiver can be alerted to the patient's noncompliance, should the patient not be taking their medication, thereby providing the caregiver with an opportunity to follow up with the patient before severe complications result from not taking the medication. In addition to accessing information within the CPU 52, the party communicating with the communication board 100 may also send information to the communication board 100, and thus the CPU 52. Accordingly, the party, having a proper authorization code, can program the apparatus 10 to follow immediate or future instructions, for example dispensing medications or alerting the patient or third party to some action.

Figure 8:
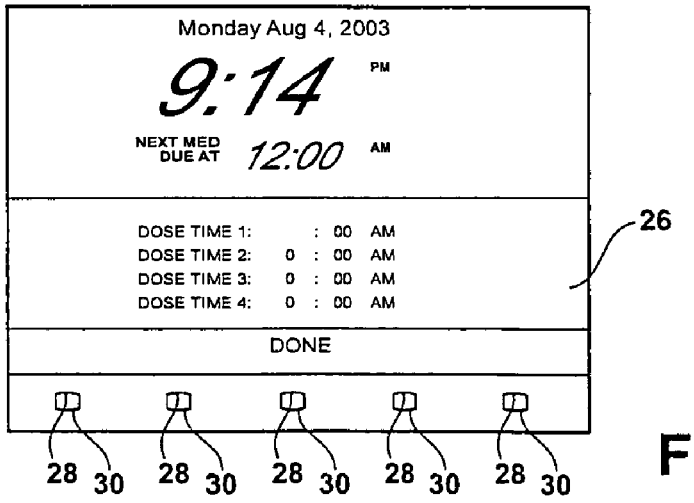
FIG. 8 is a view of the interface screen in a dose programming mode.

Still referring to FIG. 7, the user may manually program the specified times to dispense medication by pressing the "dose setup" key 30. Upon pressing the key 30, the proper times may be input to the CPU 52. If the user inputs entries having equal time increments, the CPU 52 will recognize it, and then cue the user to see if the user wants to select an automatic schedule having the equal time increments between the prescribed times to take the medication. Ultimately, this saves the user from having to manually enter repeated and equally incremented windows of time in which to take medication. As shown in FIG. 8, the dosage times scroll across the interface screen 26 so that the user can be assured of proper time inputs. When the information is entered, the user presses the "done" key 30. It should be recognized that the user need not enter dosage times if the packages 12 have readable text, bar code, or other readable formats including the dosage time information.

The apparatus 10 is generally portable, and as such, the power module 38 preferably has a DC battery backup power source, as well as an AC wall plug connector. Desirably, the batteries are rechargeable, such that they recharge when the apparatus 10 is plugged into a standard 110V outlet. In one presently preferred form, the apparatus 10 is about fifteen inches (15") tall, eight inches (8") wide and fifteen inches (15") deep. It should be recognized, however, that the apparatus 10 may be constructed having smaller or larger dimensions, as desired.

Figure 9:
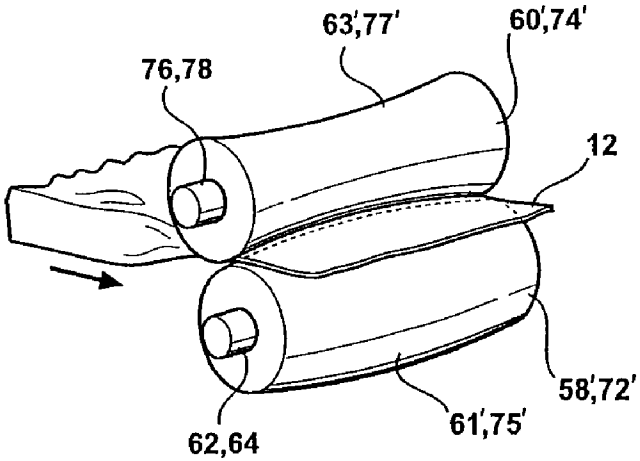
FIG. 9 is a partial perspective view showing another embodiment of a pair of rollers within a feed mechanism of the apparatus.

As best shown in FIG. 9, another presently preferred embodiment of a pair of feed rollers 58', 60', and/or a pair of dispensing rollers 72', 74' is shown. One of the rollers 58', 72' has an outer surface 61', 75', respectively, with a generally symmetrical convex contour, while the other roller 60', 74' has an outer surface 63', 77', respectively, with a generally symmetrical, relatively compliant concave outer surface. Having one of the feed rollers 58' and one of the dispensing rollers 72' with a generally convex outer surface 61', 75', respectively, and the other feed roller 60' and the other dispensing roller 74' with a compliant, and preferably concave outer surface 63', 77', respectively, a uniform and even feeding of the packages 12 between the feed rollers 58', 60' and the dispensing rollers 72', 74' is facilitated. It should be recognized that the outer surfaces 63', 77' may be generally cylindrical in a relaxed state, and take on their generally concave form in response to engagement with the outer surfaces 61', 75', respectively.

Figure 10:
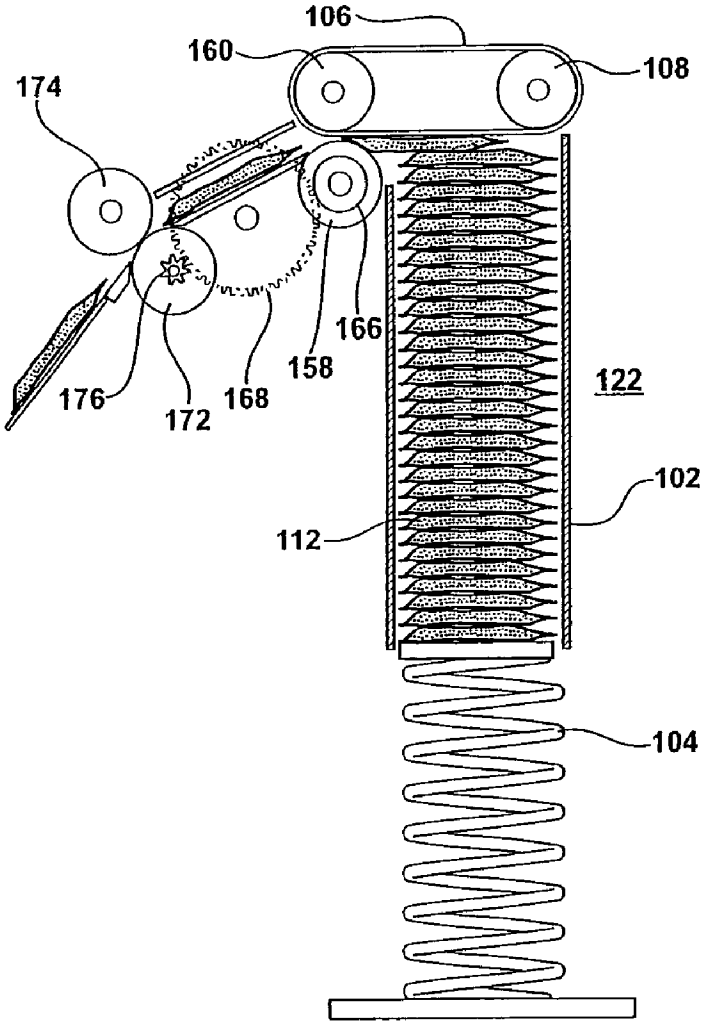
FIGS. 10 and 11 are partial side elevation views showing alternate embodiments of a feed mechanism of the apparatus.

As best shown in FIG. 10, another presently preferred embodiment is shown, wherein similar reference numerals are used to represent similar features as described in the previous embodiment, but are offset by 100. An apparatus 110 (not shown in its entirety) accommodates separate and individual packages 112 of medication for dispensation. The apparatus 110 dispenses the individual packages 112 to a patient or caregiver much as the first embodiment described above, however, instead of the packages 112 being connected to one another along a perforated seam prior to dispensation, the packages are loaded into a magazine or cartridge 102 as separate packages 112. Preferably, the packages 112 are loaded one on top of another with each package 112 arranged in similar fashion to another, and the cartridge 102 is positioned in the cavity 122 of the apparatus 110. The packages 112 are biased upwardly, for example by a spring device 104, to engage a portion of a feed mechanism, represented here as a conveyor belt 106. The conveyor belt 106 is wrapped at least partially around an upper feed roller 160 and an idler roller 108 laterally spaced from the upper feed roller 160. Accordingly, as a lower feed roller 158 is driven by actuation of a motor 148, the upper feed roller 160 is driven, and thus, the conveyor belt 106 is caused to rotate in a clockwise direction. As the conveyor belt 106 rotates, the package 112 in biased contact with the conveyor belt 106 is fed into engagement with the feed rollers 158, 160. Thereafter, the package 112 is fed between the feed rollers 158, 160 and into engagement with the dispensing rollers 172, 174 for dispensation to the patient or caregiver. The package 112 can be of a suitable length to span the distance between the feed rollers 158, 160 and the dispensing rollers 172, 174, thereby causing the packages 112 to engage the dispensing rollers 172, 174 while remaining in contact with the feed rollers 158, 160. Otherwise, if the packages 112 do not span the distance between the feed rollers 158, 160 and the dispensing rollers 172, 174, the packages 112 may be fed by gravity, or some other biasing force, into contact with the dispensing rollers 172, 174. It should be recognized that if the packages 112 do span the distance between the feed rollers 158, 160 and the dispensing rollers 172, 174, the rotational speed of the feed rollers 158, 160 and dispensing rollers 172, 174 may be adjusted through appropriate sizing of the driven gears 166, 176 to prevent the feed rollers 158, 160 and dispensing rollers 172, 174 from fighting one another while engaging the same package 112. Otherwise, the apparatus operates similarly as the first embodiment above, and therefore, is not discussed further.

Figure 11:
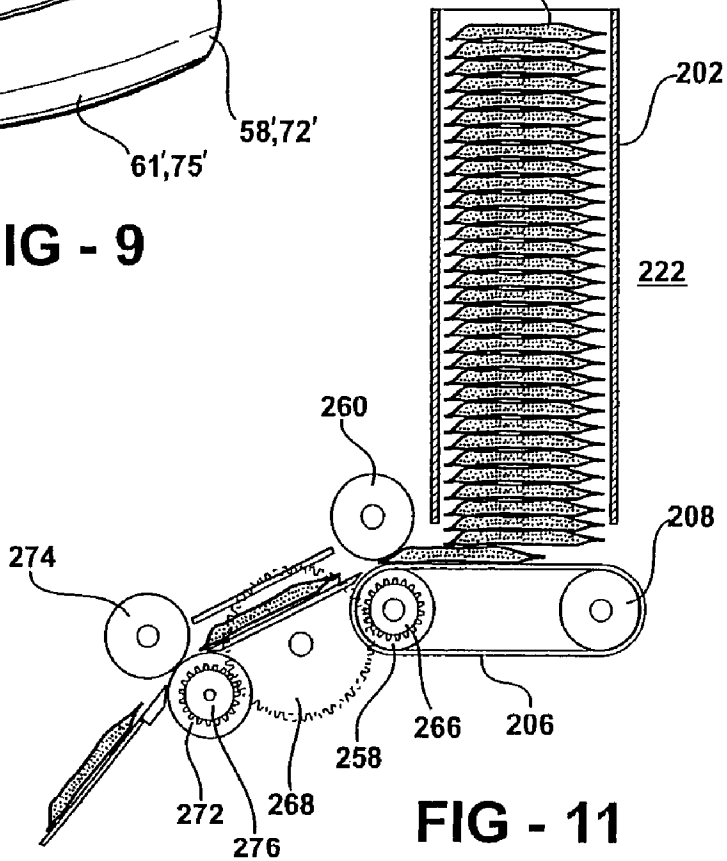

As best shown in FIG. 11, another presently preferred embodiment is shown, wherein similar reference numerals are used to represent similar features as described in the previous embodiments, but are offset by 200. An apparatus 210 (not shown in its entirety) accommodates separate and individual packages 212 of medication much like the previous embodiment. However, unlike the previous embodiment, the packages 212 are located above a conveyor belt 206 and are preferably biased into contact with the conveyor belt 206 by gravity. The conveyor belt 206 is wrapped at least in part around a lower feed roller 258 and an idler roller 208 laterally spaced from the lower feed roller 258. Accordingly, as the lower feed roller 258 is driven through actuation of a motor 248 (not shown), the conveyor belt 206 is caused to rotate in a counterclockwise direction. As the conveyor belt 206 rotates, the package 212 in biased frictional contact with the conveyor belt 206 is fed into engagement with the feed rollers 258, 260. Hereafter, the apparatus 212 operates similarly as the previous embodiments, and therefore, is not discussed further.

The disclosed embodiments are representative of presently preferred constructions of the invention, but are intended to be illustrative rather than limiting thereof. For example, it should be recognized that the gears may be replaced with sprockets and chains, pulleys and belts, or any other suitable drive linkage. One ordinarily skilled in the art will recognize other embodiments upon viewing this disclosure in its entirety. It should be understood that other embodiments of the invention which accomplish the same or similar functions are incorporated herein within the scope of the claims.

We claim:

1. An apparatus for dispensing packages of medication having dispensatory instructions thereon, comprising:

a body having an internal cavity and an outlet;

an actuator received in said cavity;

a feed mechanism having a pair of feed rollers supported for rotation on a first pair of generally parallel shafts and a pair of dispensing rollers supported for rotation on a second pair of generally parallel shafts, said first pair of shafts and said second pair of shafts being generally parallel to each other and being received in said cavity and in operable communication with said actuator for feeding and dispensing the packages of medication toward said outlet;

a processing unit in operable communication with said actuator; and a reading device received in said cavity and in communication with said processing unit, said reading device relaying the dispensatory instruction on the packages to said processing unit, said processing unit communicating with said actuator and causing said feed mechanism to dispense each of the packages toward said outlet at a specified time.

2. The apparatus of claim 1 wherein said pair of feed rollers engage opposite sides of the packages as the packages pass between said feed rollers and said pair of dispensing rollers engage opposite sides of the packages as the packages pass between said dispensing rollers.

3. An apparatus for dispensing packages of medication loaded into the apparatus as a string of joined packages having dispensatory instructions thereon, comprising:

a body having an internal cavity and an outlet;

an actuator received in said cavity;

a feed mechanism received in said cavity and in operable communication with said actuator for feeding and dispensing the packages of medication toward said outlet;

a processing unit in operable communication with said actuator;

a reading device received in said cavity and in communication with said processing unit, said reading device relaying the dispensatory instructions on the packages to said processing unit, said processing unit communicating with said actuator and causing said feed mechanism to dispense each of the packages toward said outlet at a specified time; and said feed mechanism having a pair of feed rollers biased toward one another to engage the packages and being moveable laterally away from one another as the packages engage and pass between said feed rollers and a pair of dispensing rollers biased toward one another to engage the packages and being moveable laterally away from one another to accommodate the packages as the packages engage and pass between said dispensing rollers.

4. An apparatus for dispensing packages of medication having dispensatory instructions thereon, comprising:

a body having an internal cavity and an outlet;

an actuator received in said cavity;

a feed mechanism received in said cavity and in operable communication with said actuator for feeding and dispensing the packages of medication toward said outlet;

a processing unit in operable communication with said actuator;

a reading device received in said cavity and in communication with said processing unit, said reading device relaying the dispensatory instructions on the packages to said processing unit, said processing unit communicating with said actuator and causing said feed mechanism to dispense each of the packages toward said outlet at a specified time;

said feed mechanism having a pair of feed rollers arranged to rotate at one velocity and while engaging the packages as the packages pass between said feed rollers and a pair of dispensing rollers arranged to rotate at a velocity greater than said feed rollers and while engaging the packages as the packages pass between said dispensing rollers.

5. An apparatus for dispensing packages of medication having dispensatory instructions thereon, comprising:

a body having an internal cavity and an outlet;

an actuator received in said cavity;

a feed mechanism received in said cavity and in operable communication with said actuator for feeding and dispensing the packages of medication toward said outlet;

a processing unit in operable communication with said actuator;

a reading device received in said cavity and in communication with said processing unit, said reading device relaying the dispensatory instructions on the packages to said processing unit, said processing unit communicating with said actuator and causing said feed mechanism to dispense each of the packages toward said outlet at a specified time;

said feed mechanism having a pair of feed rollers arranged to engage the packages as the packages pass between said feed rollers and a pair of dispensing rollers arranged to engage the packages as the packages pass between said dispensing rollers;

an idler member in operable communication with one of said feed rollers and one of said dispensing rollers, said idler member causing said one feed roller and said one dispensing roller to rotate in response to rotational movement of said idler member and said one dispensing roller is caused to rotate at a greater velocity than said one feed roller in response to rotational movement of said idler member.

6. The apparatus of claim 3 wherein one of said feed rollers has a driven member and said actuator has a drive member, and further comprising an idler member communicating with said driven member and said drive member causing said one feed roller to rotate in response to rotation of said actuator.

7. The apparatus of claim 4 wherein one of said dispensing rollers has a driven member and said actuator has a drive member, and further comprising an idler member communicating with said driven member and said drive member causing said one dispensing roller to rotate in response to rotation of said actuator.

8. An apparatus for dispensing packages of medication having dispensatory instructions thereon, comprising:

a body having an internal cavity and an outlet;

an actuator received in said cavity;

a feed mechanism received in said cavity and in operable communication with said actuator for feeding and dispensing the packages of medication toward said outlet;

a processing unit in operable communication with said actuator;

a reading device received in said cavity and in communication with said processing unit, said reading device relaying the dispensatory instructions on the packages to said processing unit, said processing unit communicating with said actuator and causing said feed mechanism to dispense each of the packages toward said outlet at a specified time;

said feed mechanism having a pair of feed rollers arranged to engage the packages as the packages pass between said feed rollers and a pair of dispensing rollers arranged to engage the packages as the packages pass between said dispensing rollers; and wherein one of said feed rollers and one of said dispensing rollers are laterally spaced a first distance from one another and the other of said feed rollers and the other of said dispensing rollers are laterally spaced a second distance from one another, said second distance being greater than said first distance.

9. The apparatus of claim 1 further comprising a communication board in communication with said processing unit, said communication board being operable to send a wireless electronic signal to notify a user out of visual or audio range from said apparatus that it is time to take the medication contained in one of the packages.

10. The apparatus of claim 9 wherein said communication board is operable to receive a wireless electronic signal from another electronic device remote from said apparatus to provide a user with the ability to obtain information from said processing unit and the ability to send instructions via the electronic device to said processing unit.

11. The apparatus of claim 1 wherein said reading device is a bar code scanner.

12. The apparatus of claim 1 wherein said reading device is an optical character recognition device.

13. The apparatus of claim 1 wherein said reading device is operable to read programming instructions on the packages to program said processing unit of the apparatus.

14. An apparatus for dispensing packages of medication having dispensatory instructions thereon, comprising:

a body having an internal cavity and an outlet;

an actuator received in said cavity;

a feed mechanism received in said cavity and in operable communication with said actuator for feeding and dispensing the packages of medication toward said outlet;

a processing unit in operable communication with said actuator;

a reading device received in said cavity and in communication with said processing unit, said reading device relaying the dispensatory instructions on the packages to said processing unit, said processing unit communicating with said actuator and causing said feed mechanism to dispense each of the packages toward said outlet at a specified time;

further comprising a chamber in said cavity, said chamber capturing any packages of medication not dispensed through said outlet within a specified time interval; and further comprising a lid movable between an open position and closed position, said lid while in the closed position dispensing the packages of medication through said outlet, said lid while in the open position delivering the packages of medication for capture within said chamber.

15. The apparatus of claim 14 further comprising an actuator communicating with said lid and said processing unit, said actuator being operable to move said lid between its open and closed positions.

16. An apparatus for dispensing packages of medication having dispensatory instructions thereon, comprising:

a body having an internal cavity and an outlet;

an actuator received in said cavity;

a feed mechanism having a pair of feed rollers that rotate at one velocity and a pair of dispensing rollers that rotate at a greater velocity than said feed rollers, said feed rollers and said dispensing rollers being received in said cavity and in operable communication with said actuator for feeding and dispensing the packages of medication toward said outlet;

a processing unit in operable communication with said actuator;

a reading device received in said cavity and in communication with said processing unit, said reading device relaying the dispensatory instructions on the packages to said processing unit, said processing unit communicating with said actuator and causing said feed mechanism to dispense each of the packages toward said outlet at a specified time; and further comprising a power module operably connected to the actuator and the processing unit, said power module having at least one of a direct current power source and an alternating current connector.

17. The apparatus of claim 1 further comprising an interface screen, said interface screen displaying the current time and the time the next dosage of medication is to be taken.

18. The apparatus of claim 17 further comprising a plurality of interface keys, each of said interface keys capable of changing definition providing each interface key with the ability to program multiple features within said processing unit.

* * * * *